United States Patent [19]

Speicher

[11] 4,227,454

[45] Oct. 14, 1980

[54] HYDRAULICALLY OPERATED DRUM SERIES PRINTER

[75] Inventor: Edwin W. Speicher, Pittsburgh, Pa.

[73] Assignee: M. E. Cunningham, Company, Ingomar, Pa.

[21] Appl. No.: 935,773

[22] Filed: Aug. 22, 1978

[51] Int. Cl.[3] ..... B41J 7/78

[52] U.S. Cl. ..... 101/93.01; 101/93.1; 101/95; 101/110; 101/35

[58] Field of Search ..... 101/93.01, 93.10, 93.22, 101/93.37, 93.41, 76, 18, 29, 99, 95, 96, 110, 35, 42

[56] References Cited

U.S. PATENT DOCUMENTS

| | | | |
|---|---|---|---|
| 2,891,469 | 6/1959 | Payne et al. | 101/76 |
| 2,909,992 | 10/1959 | Rockefeller | 101/76 |
| 2,922,361 | 1/1960 | Adler et al. | 101/95 |
| 3,149,562 | 9/1964 | Wilkins et al. | 101/93.10 |
| 3,603,251 | 9/1971 | Elsworth et al. | 101/76 |
| 3,616,749 | 11/1971 | Ritzerfeld | 101/76 X |
| 3,840,104 | 10/1974 | Groppini | 101/18 X |
| 3,865,030 | 2/1975 | Chida et al. | 101/93.22 |
| 4,036,127 | 7/1977 | Speicher | 101/35 X |

*Primary Examiner*—Edward M. Coven
*Attorney, Agent, or Firm*—Stanley J. Price, Jr.; John M. Adams

[57] ABSTRACT

A marking head rotatably supports a plurality of marking wheels that are supported for rotation by a shaft positioned in the marking head. The marking wheels each include a periphery with a plurality of marking characters positioned thereon for marking plates, name plates, identification plates and the like with a preselected marking character. A preselected marking character for each wheel is positioned in marking position by rotating the respective marking wheel through a preselected angle which is preferably the angle for advancing the next adjacent character into marking position. A plurality of fingers are rotatably positioned on a shaft for engaging a ratchet portion of a respective wheel. Each finger is rotatably supported to selectively move into and out of engagement with the respective ratchet portion by operation of an air actuated plunger abutting the end of the finger. After selected fingers are moved into engagement with the corresponding marking wheels, the shaft supporting the fingers is moved downwardly in an arcuate path through a preselected angle to move the fingers through a corresponding angle and thereby rotate the marking wheels engaged by the fingers through a preselected angle. The engaged marking wheels are turned so that the marking characters or indicia positioned in marking position are moved out of marking position and the next adjacent characters on the periphery of the marking wheels are moved into marking position. Once the selected indicia are moved into marking position, the fingers are disengaged from the respective ratchet portion and rotated backwardly in an arcuate path to their initial position.

13 Claims, 4 Drawing Figures

HYDRAULICALLY OPERATED DRUM SERIES PRINTER

BACKGROUND OF THE INVENTION

1. Field of the Invention

This invention relates to a marking apparatus and more particularly to a marking apparatus having a plurality of wheels rotatably positioned on a shaft and including a plurality of marking characters on the periphery of each wheel such that the marking characters are selectively moved into marking position.

2. Description of the Prior Art

U.S. Pat. Nos. 3,541,954 and 3,654,860 disclose devices for impressing upon billets, slabs, and the like a group of marking characters by marking wheels having a plurality of characters on the outer periphery of the wheels. Character selection is accomplished by rotating each marking wheel until the desired character on the wheel periphery is in marking position. Each wheel has a ratchet portion on one side that is actuated by a pawl connected to an actuating slide. The pawl rotates the marking wheel for character selection. A position indicator associated with the marking wheel transmits a signal to a remote location for indicating the relative position of the marking wheel. With this arrangement the relative angular position of each marking wheel and the character in marking position is indicated remotely. A spiral cam is provided on each rotatable wheel, and a signal device in abutting relation with the spiral cam transmits a signal to the remote location to thereby indicate the relative angular position of the wheel.

Number printing and recording devices for selectively marking sheets of material with letters and/or numbers are known in the art and include wheels or rolls having marking characters positioned on the periphery thereof. The wheels or rolls are selectively rotated to position the desired character in marking position. Examples of such devices are disclosed in the following U.S. Pat. Nos. 2,891,469; 2,909,992; 2,923,233; 3,598,044; 3,603,251; 3,616,749; 3,859,914 and 3,938,436.

One problem encountered with character selection of a marking wheel is wear of the pawl that is engageable with the ratchet portion of the wheel by the continued application of force upon the pawl to rotate the pawl and thereby turn the wheel to move the next adjacent character into marking position. With the conventionally known devices, after the pawl has been moved into engagement with the ratchet portion, the pawl is swung in an arcuate path through a preselected angle by the application of a force directly upon the pawl. This direct application of force to the pawl to swing the pawl and thereby turn the wheel after a period of continued use necessitates a replacement of the pawl and other associated components, such as the return spring which normally maintains the pawl disengaged from the wheel.

Therefore, there is need to provide in a marking apparatus, having a marking wheel selectively engaged by a pawl, means for moving the pawl to rotate the wheel without directly applying force to the pawl so as to eliminate wear thereon and extend the life of the pawl and increase the efficiency of the marking apparatus.

SUMMARY OF THE INVENTION

In accordance with the present invention there is provided marking apparatus that includes a marking head. A wheel is rotatably supported by the marking head. The wheel has a periphery with a plurality of marking characters positioned thereon. A ratchet portion is provided on the wheel. A first shaft is positioned adjacent the wheel. An engaging device is rotatably positioned on the first shaft for engaging the ratchet portion. A pressure device moves the engaging device into engagement with the ratchet portion. An actuator mechanism moves the first shaft in an arcuate path through a preselected angle so that the engaging device moves through a corresponding angle to rotate the wheel in a preselected direction through an angle corresponding to the angle of movement of the engaging device and thereby advance the marking characters on the wheel.

The engaging device has a first end portion and a second end portion. The first end portion is movable into and out of engagement with the ratchet portion. The second end portion is positioned in abutting relation with the pressure device. A resilient member is positioned on the first shaft and is operable to exert a force upon the engaging device to normally maintain the first end portion of the engaging device disengaged from the ratchet portion and the second end portion of the engaging device abutting the pressure device. The pressure device is operable upon actuation to exert a force upon the second end portion and overcome the force of the resilient member to pivot the engaging device on the first shaft and move the first end portion into engagement with the ratchet portion.

The first shaft is normally maintained in a first position with the engaging device disengaged from the ratchet portion. The pressure device upon actuation is operable to pivot the engaging device into engagement with the ratchet portion, with the first shaft in the first position. Thereafter, the actuator mechanism is operable upon actuation to move the first shaft in an arcuate path to a second position so that the engaging device rotates the wheel to advance the wheel one marking character. The pressure device, after advancement of the wheel, is operable to release the engaging device from engagement with the ratchet portion before the actuator mechanism moves the first shaft from the second position back to the first position.

Preferably, the actuator mechanism includes a pair of double-acting pneumatic cylinders that are connected to opposite ends of the first shaft and pivotally mounted on the marking head. The pressure device preferably includes a pneumatic actuated plunger that is reciprocally positioned within the air chamber of a supporting block. One end portion of the plunger is maintained in abutting relation with the second end portion of the engaging device. When the air chamber is pressurized, the plunger is extended from the supporting block to pivot the first end portion of the engaging device into engagement with the ratchet portion of the wheel. Following engagement of the wheel ratchet portion, the double-acting pneumatic cylinders are actuated to move the first shaft in an arcuate path and thereby rotate the wheel and advance the next adjacent character into marking position.

In a further embodiment of the present invention, a plurality of wheels are rotatably supported by the marking head. Accordingly, each wheel has a periphery with a plurality of marking characters positioned thereon. A ratchet portion is provided for each wheel. A plurality of engaging devices are pivotally positioned on the first shaft and are operable to selectively engage the ratchet portions of the respective wheels. A plurality of pressure devices selectively move preselected engaging devices into engagement with the ratchet portions of the respective wheels. Thereafter, the actuator means moves the first shaft in an arcuate path through a preselected angle to turn the wheels engaged by the respective engaging devices in a preselected direction through an angle corresponding to the angle of movement of the engaging devices and thereby selectively advance the marking characters.

Further, in accordance with the present invention, there is provided a method for controlling the movement of the marking characters of a marking wheel that includes the following steps: A marking wheel having a ratchet portion is rotatably supported in a marking head. An engaging device is rotatably supported on a shaft positioned adjacent the marking wheel. The engaging device is pivoted on the shaft into engagement with the ratchet portion of the marking wheel. The shaft is moved in an arcuate path through a preselected angle to rotate the engaging device through an angle corresponding to the angle of movement of the shaft. The marking wheel engaged by the engaging device is turned upon movement of the shaft through a preselected angle to advance a selected marking character into marking position.

Accordingly, the principal object of the present invention is to provide a marking apparatus having a marking wheel with a plurality of marking characters or indicia positioned on the periphery of the wheel in which the marking wheel is automatically and selectively rotated on a shaft to advance a preselected marking character on the periphery of the marking wheel into marking position.

Another object of the present invention is to provide a rotatable marking wheel having a ratchet portion, engagable by a lever, which is selectively movable into engagement with the ratchet portion so that when the shaft upon which the lever is rotatably mounted is moved in an arcuate path through a preselected angle, the wheel being engaged by the lever is turned through a corresponding angle to position a selected marking character in marking position.

A further object of the present invention is to provide a method and apparatus for controlling the movement of a plurality of marking wheels rotatably supported in a marking head to selectively move the marking characters of the wheels into marking position.

These and other objects of this invention will be more completely disclosed and described in the following specification, the accompanying drawings and the appended claims.

DESCRIPTION OF THE PREFERRED EMBODIMENT

Figure 2:
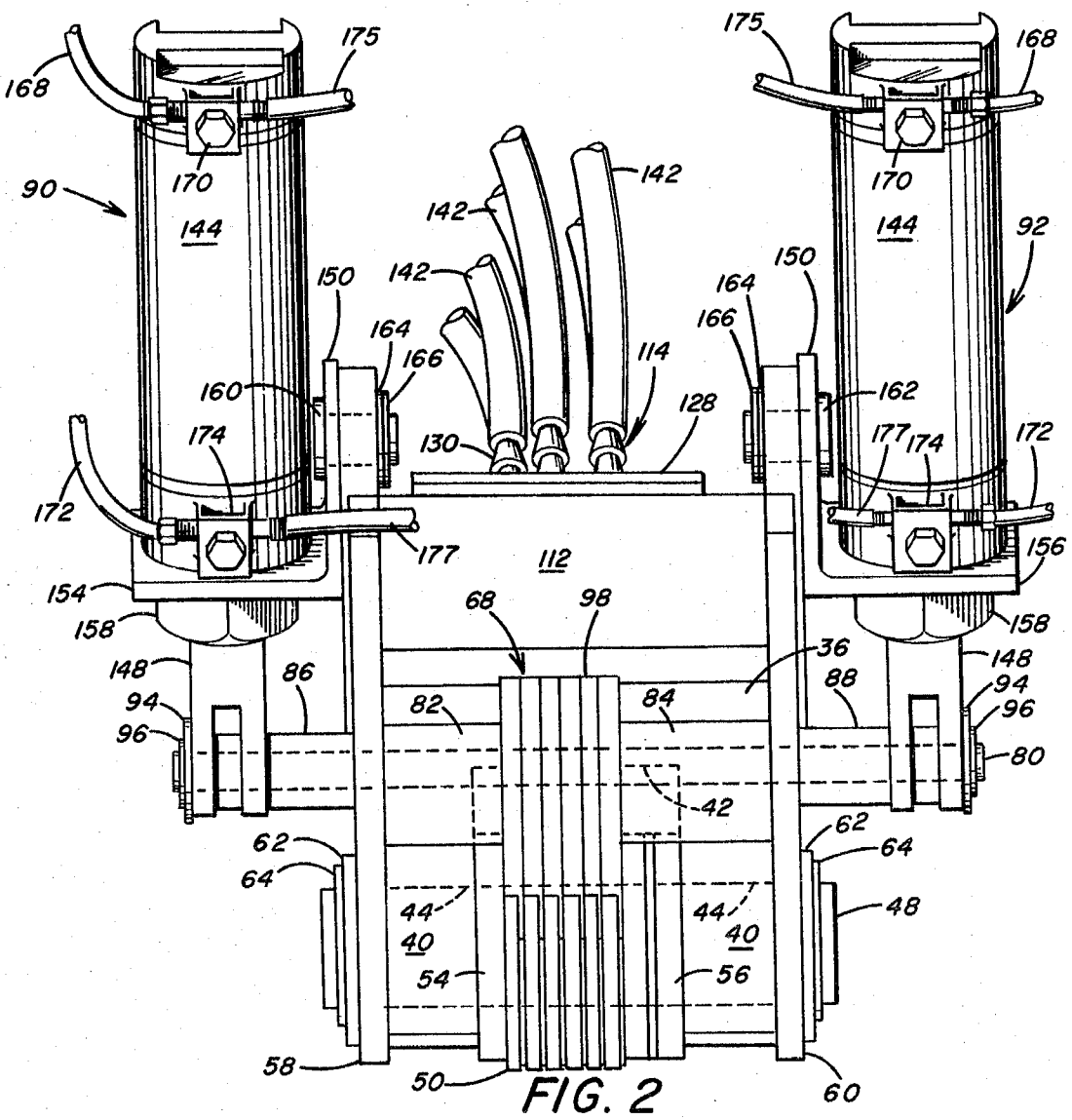
FIG. 2 is an enlarged, fragmentary rear view of the marking head, illustrating a plurality of marking wheels that are rotatably supported in the marking head and selectively rotated to advance marking characters on the wheels into marking position.
Figure 1:
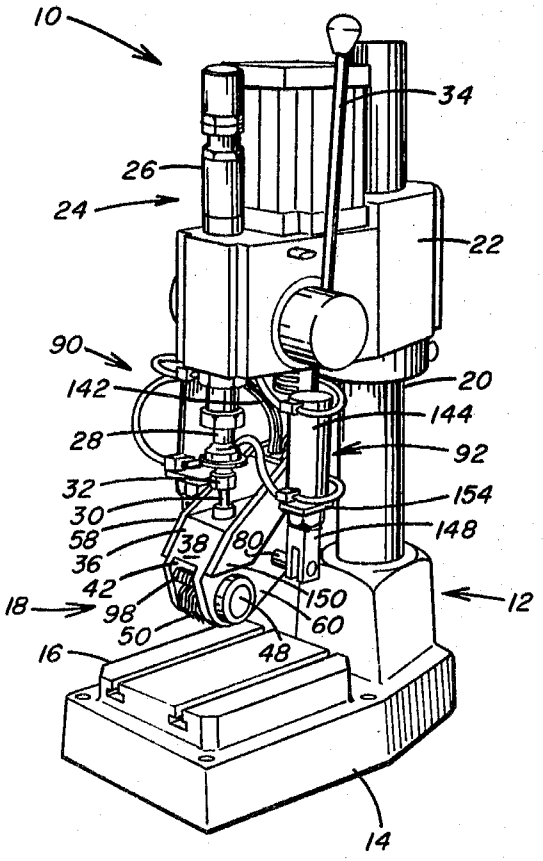
FIG. 1 is a perspective view of a marking machine, illustrating the marking apparatus of the present invention for remotely and automatically turning selected marking wheels to advance characters on the marking wheels into position for marking an article positioned on the machine.

Referring to the drawings and particularly to FIGS. 1 and 2 there is illustrated a marking machine generally designated by the numeral 10 that includes a press frame 12 having a base portion 14 with a table 16 for supporting a work piece, such as a name plate, an identification plate, or the like (not shown), to be marked by a marking apparatus generally designated by the numeral 18. A mast 20 is supported by the base portion 14 and extends vertically upwardly therefrom. A carriage 22 is vertically movable on the mast 20 and is pivotal on the mast 20 for swinging movement in a horizontal plane to move the marking apparatus 18 into and out of marking position above the table 16. With this arrangement by horizontally pivoting the carriage 22 on the mast 20 the marking apparatus 18 is moved into overlying relation with the table 16. By moving the carriage 22 vertically on the mast 20 the marking apparatus 18 is lowered into a position for marking a work piece positioned on the table 16.

A striking tool generally designated by the numeral 24 is supported by the front end portion of the carriage 22. The striking tool 24 includes a tubular body portion 26 and a tool insert 28 that extends out of the lower end portion of the tubular body portion 26. The marking apparatus 18 includes an upwardly extending stem portion 30 that is releasably engagable to a chuck 32 that is connected to the lower end of the tool insert 28. A hammer (not shown) is supported for vertical reciprocal movement within the tubular body portion 26. A spring (not shown) is positioned in the tubular body portion and is operable to be compressed and when released to exert a force against the hammer to move the hammer longitudinally in the tubular body portion 26 to strike the upper end of the tool insert 28. Thus, with this arrangement, when the marking apparatus 18 is in contact with a work piece on the table 16, the force imparted to the tool insert 28 by the hammer is transferred to the marking apparatus 18 to impress a mark in the surface of the work piece.

Actuation of the striking tool 24 may be accomplished manually by operation of a lever 34 which is operatively connected to the striking tool 24 and pivotally supported on the carriage 22. The striking tool 24 may also be pneumatically or electrohydraulically operated. A suitable striking tool adaptable for use with the present invention is illustrated in the U.S. Pat. No. 2,455,270. However, any other commercially available striking tool of the type above described may be utilized with the present invention, such as the striking tool and press-type marking machine sold by M. E. Cunningham Company of Ingomar, Pa. The striking tool 24 is beyond the scope of the present invention and will not be described in greater detail.

Figure 4:
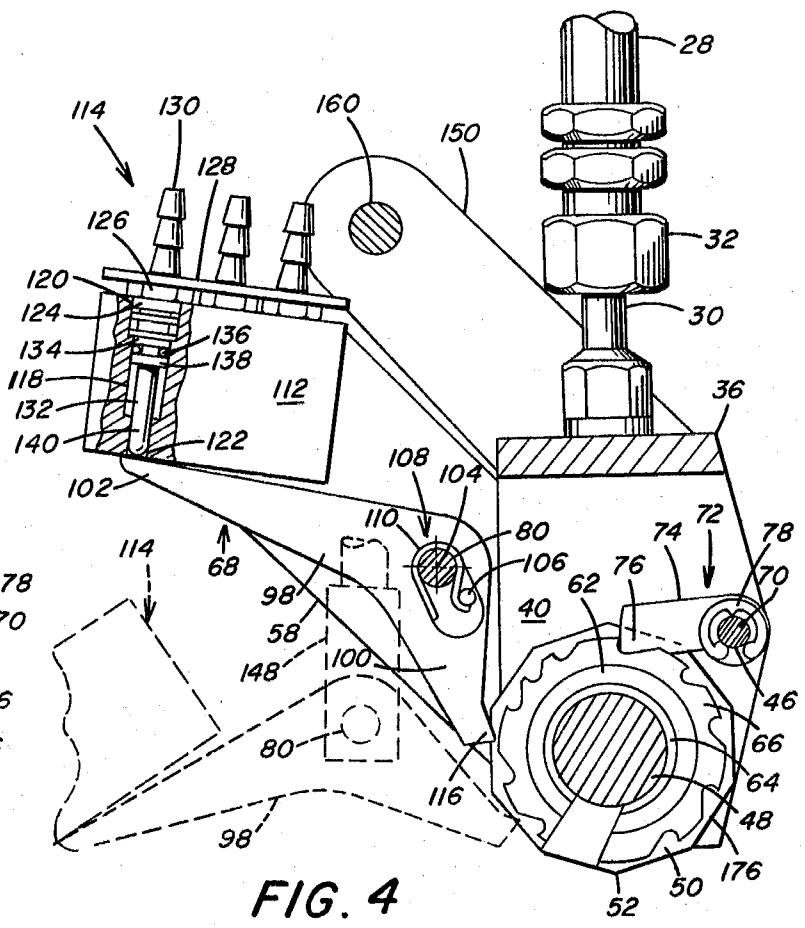
FIG. 4 is an enlarged, fragmentary view in side elevation, and partially in section, similar to FIG. 3, illustrating the lever disengaged from the ratchet portion of the wheel in a first position and in a second position shown in phantom displaced from the first position.
Figure 3:
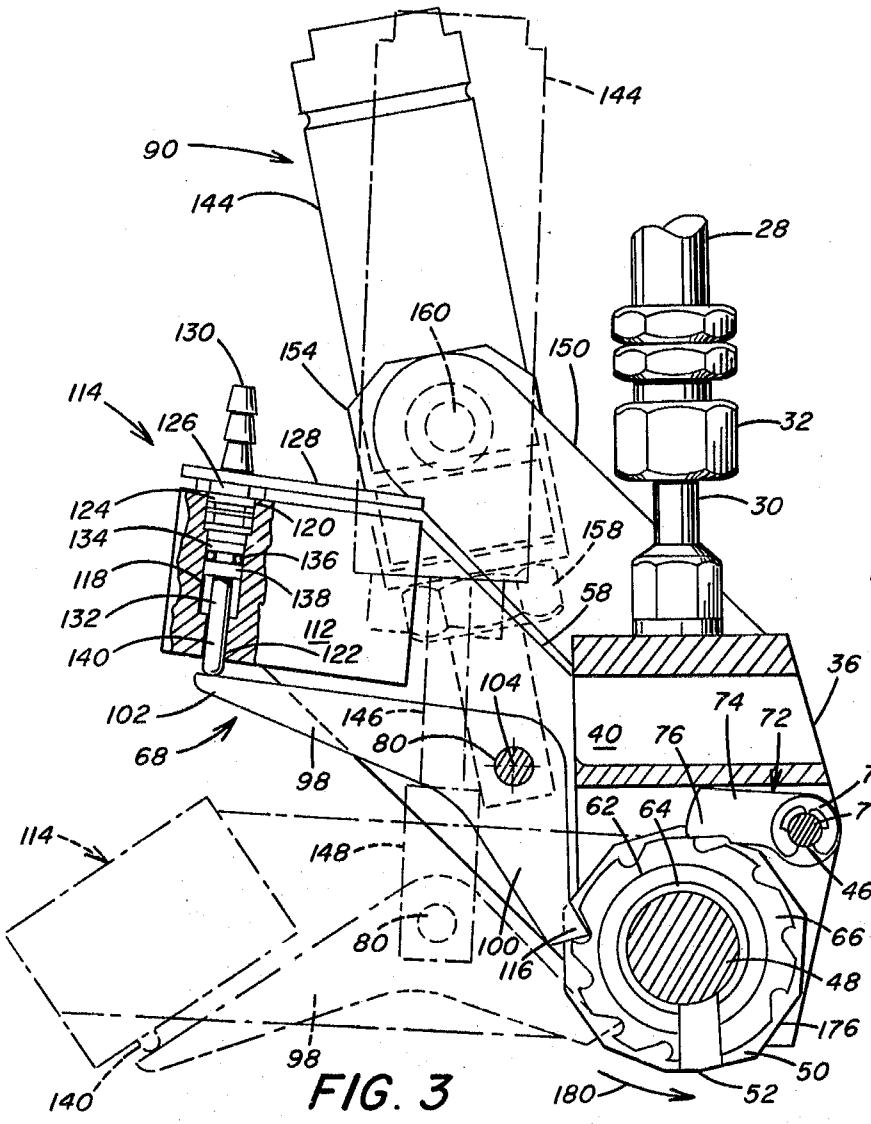
FIG. 3 is an enlarged, fragmentary view in side elevation, and partially in section, of the marking head, illustrating one of a plurality of levers operable to be pivoted by a pneumatically actuated plunger, only one of which is shown in FIG. 3, into engagement with the ratchet portion of a wheel and the lever, as illustrated in phantom, moved to a position to advance the next adjacent character into marking position.

The marking apparatus 18, illustrated in FIG. 1 and further in greater detail in FIGS. 2–4, includes a marking head 36 having a U-shaped body portion that includes an upper transverse portion 38 and a pair of arm members 40 that extend downwardly from the opposite ends of the transverse portion 38 to form a generally rectangular shaped recess 42 in the marking head 36. The stem portion 30 extends upwardly from the transverse portion 38 for removable connection with the chuck 32 of the tool insert 28. With this arrangement, the marking apparatus 18 is removable from connection with the striking tool 24 and the press frame 12 of the marking machine 10.

The marking head 36 includes spaced parallel bores 44 and 46 that extend through the arm members 40. A wheel shaft 48 extends through the bores 44. A plurality of marking wheels 50 each having a plurality of characters or marking indicia on their outer peripheral surface 52 are rotatably positioned on the wheel shaft 48. Any number of marking wheels may be positioned on the wheel shaft 48. Preferably, the marking wheels are centered on the wheel shaft 48 between the arm members 40 by wheel spacers 54 and 56, as illustrated in FIG. 2.

A pair of levers 58 and 60 having bores extending therethrough are mounted on the wheel shaft 48 adjacent the outboard side of the pair of arm members 40. The levers 58 and 60 are held in place on the wheel shaft 48 by washers 62 and snap rings 64. With this arrangement the wheel shaft 48 can be easily removed from the marking head 36 to facilitate a change in the number of marking wheels 50 positioned on the wheel shaft 48.

Each marking wheel 50 has a ratchet portion 66 on one side of the respective wheel. An engaging device generally designated by the numeral 68 and illustrated in detail in FIGS. 3 and 4 turns the respective marking wheels 50 to position selected characters in marking position above the table 16 of the marking machine 10. A pin 70 extends through the bores 46 of the arm members 40. The pin 70 rotatably supports a plurality of stop devices generally designated by the numeral 72 that are operable to prevent rotation of the marking wheels 50 in a clockwise direction as illustrated in FIG. 4.

Preferably, the stop devices 72 include a plurality of locking fingers 74 in which each locking finger 74 is operable to engage the ratchet portion 66 of a marking wheel 50. Each locking finger 74 is pivotally mounted on the pin 70 and includes a pawl 76 that is urged in a counterclockwise direction into abutting relation with the respective ratchet portion of marking wheel 50 by a spring (not shown). With this arrangement each marking wheel 50 is operable to rotate freely in a counterclockwise direction on the wheel shaft 48 but is restrained from clockwise rotation by engagement of the locking fingers 74 with the wheel ratchet portions 66. The pin 70 is removably positioned on the marking head arm members 40 by a pair of snap rings 78, one of which is illustrated in FIGS. 3 and 4.

The engaging devices 68 are rotatably positioned on a shaft 80 that extends through aligned bores of the levers 58 and 60 to support the shaft 80 in spaced parallel relation with the wheel shaft 48. An engaging device 68 is positioned opposite each marking wheel 50 so that each marking wheel 50 is provided with an engaging device on shaft 80. The engaging devices 68 are maintained in proper alignment with the corresponding marking wheels 50 by spacers 82 and 84, as illustrated in FIG. 2. Also, spacers 86 and 88 are positioned on the shaft 80 between the arm members 40 and a pair of actuator devices generally designated by the numerals 90 and 92.

The actuator devices 90 and 92 are connected at one end portion to the respective ends of the shaft 80 and are securely held in place on the shaft 80 in abutting relation with the spacers 86 and 88 by washers 94 and snap rings 96. The actuator devices 90 and 92 are operable in a manner which will be described later in greater detail to turn the marking wheels 50 to advance selected characters on the periphery of the marking wheels into marking position.

Each of the engaging devices 68 includes a finger or lever 98 having a first end portion 100 and a second end portion 102 with a fulcrum point 104 positioned between the end portions 100 and 102. Each finger 98 is rotatably supported about its fulcrum point 104 on the shaft 80. Adjacent the shaft 80 is a pin or wire member 106 that extends through aligned bores of each finger. A resilient device generally designated by the numeral 108, such as a torsion spring 110, engages at one end portion the pin 106 and extends around a substantial portion of the circumference of the shaft 80 to a second end portion extending downwardly from the shaft 80.

The spring 110 normally exerts a force upon the shaft 80 to rotate the fingers 98 in a clockwise direction about the shaft 80. Thus, the finger second end portion 102, as illustrated in FIG. 4, is normally maintained in abutting relation with the lower surface of a block member 112 of a pressure device generally designated by the numeral 114. The opposite end portion 100 of each finger 98 includes a pawl 116 that extends from the end portion 100 between adjacent marking wheels. The pawl 116 is operable, in a manner to be described hereinafter in greater detail, to move into engagement with a ratchet of the marking wheel ratchet portion 66, as illustrated in FIG. 3. A finger 98 is illustrated in its normally disengaged position with the ratchet portion 66 in FIG. 4.

The pressure device 114 is positioned rearwardly of the marking head 36 and is suitably secured as by threaded members (not shown) to the upper end portions of the pair of levers 58 and 60 that rotatably support the wheel shaft 48 and the shaft 80. The block 112 includes a plurality of chambers 118 corresponding in number to the number of associated pairs of fingers 98 and marking wheels 50. Each chamber 118 includes an inlet 120 and an outlet 122. A fitting 124 is positioned in each chamber 118 at the inlet 120. For purposes of clarity of illustration only one chamber 118 and the fitting 124 therefor is shown in FIG. 3; however, a selected number of chambers and fittings may be provided as determined by the number of marking wheels 50 positioned in the marking head 36.

The fitting 124 includes an enlarged annular portion 126 positioned in abutting relation with the upper surface of the block 112 on one side and in abutting relation on the opposite side with a plate 128 having a plurality of bores extending therethrough to permit a nozzle inlet portion 130 of the fitting 124 to extend above the plate 128. The fittings 124 are securely positioned in the chambers 118 at the inlets 120 thereto in a manner to seal the inlets 120 from the escape of air around the fittings 124. A bore extends from the nozzle inlet 130 through the fitting 124 to permit a fluid, such as air, under pressure to be supplied by a conduit connected to the nozzle inlet 130 through the fitting 124 and into the chamber 118.

A plunger 132 is positioned for upward and downward reciprocal movement in the chamber 118 below the end of the fitting 124. The plunger 132 is illustrated in FIG. 4 in a retracted position in the chamber 118 and includes an enlarged flanged end portion 134 spaced by an O ring 136 from a second flanged end portion 138. The flange portions 134 and 138 retain the O ring in surrounding relation and longitudinally fixed on a shaft portion 140 of each plunger to sealingly engage the wall of the block 112 surrounding the chamber 118. With this arrangement the portion of the chamber 118 above the O ring 136 is sealed from the portion of the chamber 118 below the O ring.

Preferably, as illustrated in FIGS. 1 and 2 a flexible conduit 142 is connected to the nozzle inlet 130 of each of the fittings 124. The respective conduits 142 are connected by one way valves (not shown) to a source of pressurized air. By selectively opening the valves pressurized air is supplied to selected nozzle inlets 130. Normally each chamber 118 is maintained at standard pressure. The end portion of the plunger shaft 140 is positioned within the chamber inlet 120 so that the finger end portion 102 is positioned in abutting relation with the lower surface of the block 112. The fingers 98 are maintained in this position by the action of the torsion spring 110, as above described, so that the finger pawl 116 is pivoted out of engagement with the wheel ratchet portion 66.

By pressurizing a selected chamber 118, upon the introduction of air through the corresponding conduit 142 and nozzle inlet 130, the plunger is moved downwardly in the chamber 118 to extend the end of the plunger shaft 140 out of the outlet 122 and into engagement with the finger end portion 102. The force of the plunger 132 acting on the finger end portion 102 pivots the finger 98 about the fulcrum point 104 on the shaft 80 to move the pawl 116 into engagement with the wheel ratchet portion 66. The finger 98 remains in this position as long as the chamber 118 is pressurized to extend the plunger 132.

As above discussed, the ends of shaft 80 are connected to the actuator devices 90 and 92 which, preferably, are double-acting, pneumatic cylinders. Each actuator 90 and 92 includes a cylinder portion 144 and a piston rod 146 movably positioned in the cylinder 144 and operable to extend and retract relative to the cylinder portion 144. Each piston rod 146 includes a bifurcated end portion 148 having a bore therethrough. The finger shaft 80 extends through the bores of the bifurcated end portion 148. The bifurcated end portions 148 are spaced from levers 58 and 60 by the spacers 86 and 88. The end portions 148 are retained on the ends of the shaft 80 by the washers 94 and snap rings 96.

A pair of arm supports 150, as illustrated in FIG. 2, are secured by bolts at one end portion to the upper ends of the pair of arm members 40 and extend upwardly and rearwardly therefrom to an opposite end portion positioned adjacent to and spaced laterally from the cylinders 144. A pair of angle members 154 and 156 are secured to the end of the cylinders 144 at the piston rod end portions thereof by adjusting nuts 158.

The angle members 154 and 156 extend upwardly between the pair of arms 40 and the cylinders 144 and are positioned in abutting relation with the ends of the arms 40. The arms 40 and the angle members 154 and 156 include aligned bores through which extend pivot pins 160 and 162, respectively. The pivot pins 160 and 162 are held in place in the aligned bores by washers 164 and snap rings 166. With this arrangement the cylinders 144 are supported by the marking head 36 for pivotal movement from an angular position, as illustrated by the solid lines in FIG. 3, to a pivoted vertical position, as illustrated by the dotted lines in FIG. 3.

Pivoting of the cylinders 144 about the pivot pins 160 and 162 is accomplished by conducting fluid, such as air, under pressure from suitable valves (not shown) through conduits 168 that are connected to the upper ends of cylinders 144 by fittings 170. Each fitting 170 includes an inlet communicating with the end of tubing such as a conduit 168 and an outlet communicating with the interior chamber of cylinder 144 behind the piston rod 146. Upon the flow of pressurized air from the valve through the conduit 168 and through the inlet of fitting 170 into the cylinder 144, the piston rod 146 is extended from the end of the cylinder. In a similar manner to retract an extended piston rod 146 back into the cylinder 144, air is conveyed from a valve (not shown) through a conduit 172 into the inlet of a fitting 174 having an outlet communicating with the opposite end of the interior chamber of cylinder 144. When the upper end of cylinder 144 is vented through the outlet of fitting 170 and conduit 175, air, conveyed through conduit 172 and the inlet of fitting 174 into cylinder 144, urges the piston rod 146 back into cylinder 144. With this arrangement the rod 146 is positively extended and retracted out of and into cylinder 144 upon actuation of suitable valves that control the flow of pressurized air to and from the fittings 170 and 174 which are suitably clamped to the opposite end portions of the cylinders 144.

Referring to FIGS. 3 and 4, each of the marking wheels 50 includes a plurality of planar faces 176 on the periphery of the marking wheel 50. Marking indicia or characters, such as numbers or letters (not shown), are positioned on the planar faces 176 and project outwardly therefrom in a manner well known in the art. Accordingly, the wheels 50 are rotated to selectively position marking indicia in marking position for stamping an article with the indicia. In one method of operation when one article is marked, one or more wheels are turned to advance the next adjacent character into the marking position. The process is continued so that a plurality of articles are marked in a preselected order so that, for example, a plurality of articles may be consecutively lettered and/or numbered. In another method of operation preselected indicia may be moved into marking position for marking a plurality of objects with the same indicia, the indicia in marking position then changed, and another quantity of objects identically marked by new indicia moved into marking position.

The selective rotation of the marking wheels 50 to position preselected marking characters or indicia in marking position is accomplished by pivoting the finger 98 corresponding to the marking wheel to be turned into engagement with the ratchet portion 66 of the respective wheel 50. Accordingly, engagement of a finger 98 with its corresponding ratchet portion 66 is accomplished by pivoting the finger 98 from the position illustrated by the solid lines in FIG. 4 to the position illustrated by the solid lines in FIG. 3 where the pawl 116 is positioned in a recess of the ratchet portion 66. By pressurizing selected chambers 118, the plungers 132 therein are moved from a retracted position as illustrated in FIG. 4 to an extended position as illustrated in FIG. 3.

Pressurizing the chambers 118 is controlled by the remote operation of conventional valves that permit pressurized air to flow from a source through the conduits 142 to the attached nozzle inlets 130. The remote operation of pressurizing the chambers 118 in one embodiment of the present invention is carried out be the apparatus illustrated and described in U.S. Pat. Nos. 3,541,954 and 3,654,860 which are incorporated herein by reference. The apparatus for remotely controlling the turning of the marking wheels 50 is beyond the scope of the present invention and reference is made to the above patents for the details of this operation. Thus, the flow of air to the respective fittings 124 may be controlled by manual or automatic operation of the valves that control the flow of air through the conduits to the respective fittings.

Referring to FIG. 3, with the rods 146 retracted in the cylinders 144, the shaft 80 is maintained in a first position for pivoting of the finger pawl 116 into engagement with the wheel ratchet portion 66 by pressurizing the chamber 118 behind the plunger 132. Pressurizing chamber 118 extends the end of the plunger shaft 140 from the outlet 122. The force exerted upon the finger end portion 102 is greater than the force exerted by the spring 110 on the finger so that the finger 98 rotates on the shaft 80 until the pawl 116 is moved into engagement with the ratchet portion 66.

Immediately following the engagement of selected fingers 98 with the corresponding wheel ratchet portions 66, the devices 90 and 92 are actuated by conveying pressurized air through conduits 168 and fittings 170 to the upper ends of the cylinders 144. The lower ends of the cylinders 144 are vented through the fittings 174 and conduits 177. Thus, the cylinders 144 are pressurized and the piston rods 146 extended from the cylinders, as illustrated in FIG. 3. Extension of the piston rods 146 pivots the cylinders 144 about the pivot pins 160 and 162 so that the shaft 80 connected to the piston rods 146 moves downwardly in an arcuate path from a raised position, as illustrated by the solid lines in FIG. 3, to a lowered position, as illustrated by the dotted lines in FIG. 3.

The pivoted movement of the fingers 98 from the raised position to the lowered position, as illustrated in FIG. 3, turns the engaged wheels 50 through a preselected angle for advancing the next adjacent characters into marking position. The length of the extension of the piston rods 146 from the cylinders 44 limits the downward arcuate movement of the fingers 98 through said preselected angle so the wheels 50 are not turned through an angle to the extent that the next adjacent character is moved into and then out of the marking position when the piston rods 146 are extended. With this arrangement the marking wheels 50 are advanced one marking character upon each downward stroke of the piston rods 146. As the shaft 80 is swung downwardly, the levers 58 and 60 being secured to the shaft 80 are carried with the shaft to in turn move the block 112 downwardly with the levers 58 and 60. In this manner the plungers 132 of the pressurized chambers 118 remain extended and in contact with the finger end portions 102 to assure that the finger pawls 116 remain engaged with the wheel ratchet portions 66.

With selected fingers 98 engaging the corresponding marking wheels 50, downward arcuate movement of the fingers turns the respective marking wheels 50 about the wheel shaft 48 in a counterclockwise direction as indicated by the arrow 180 in FIG. 3. Preferably, the piston rods 146 are extended so that the wheels are turned to move one marking character out of marking position and the next adjacent character into marking position as above discussed. Accordingly, the length of extension of the piston rods 146 from the cylinders 44 limits the angle through which each finger 98 and engaged marking wheel 50 is turned.

Following extension of the piston rods 146 and the turning of the marking wheels 50 engaged by the fingers 98, the pressurized chambers 118 are vented by opening the valves for supplying pressurized air to the respective nozzle inlets 130. Venting the chambers 118 removes the force on the finger end portions 102 opposing the force applied to the finger end portions 100 by the spring 110. The force of the spring 110 rotates the fingers 98 in a clockwise direction on the shaft 80. This releases the finger pawls 116 from engagement with the wheel ratchet portions 66 and urges the finger end portions 102 into abutting relation with the block 112. Thus further clockwise rotation of the fingers 98 is restrained by contact of the fingers with the block 112.

Following venting of the pressurized chambers 118, the opposite end portions of the cylinders 144 are pressurized by conducting air under pressure through the conduits 172 and the fittings 174 into the cylinders 144 and venting the upper end portions of the cylinders 144 through the fittings 170 and conduits 175. The piston rods 146 are retracted into the cylinders 144 so that the cylinders are pivoted back to their initial position and the fingers 98 are swung back through an arcuate path to their initial position relative to the marking head 36.

In order to maintain the selected marking characters in the marking position, each marking wheel 50 is prevented from rotating in a clockwise direction by engagement of the pawl 76 of locking finger 74 with the ratchet portion 66. FIG. 4 illustrates the wheel 50 fixed in a preselected marking position by engagement of the locking finger 74 with the wheel ratchet portion 66. As illustrated in FIG. 3, the pawl 76 is free to move out of engagement with the ratchet portion 66 upon counterclockwise rotation of the wheel 50 in the direction of arrow 180. FIG. 3 illustrates the locking finger 74 disengaged from the ratchet portion 66 when the wheel 50 is turned by movement of the finger 98 from the position illustrated by the solid lines to the position illustrated by the dotted lines. With this arrangement the wheel 50 remains fixed in its selected position following extension of the piston rods 146 after the fingers 98 are removed from engagement with the wheel ratchet portion 66.

For each operation of pressurizing the chambers 118 and actuating the devices 90 and 92, a wheel 50 is turned on a shaft 48 to turn the wheel one character. Therefore, any marking character on the periphery of the marking wheel 50 may be moved into the marking position by continued pressurizing of the selective chamber 118 and actuation of the devices 90 and 92 until the wheel 50 has been turned to position the preselected marking character in marking position. On the other hand, in accordance with the practice of the present invention one or more of the wheels may be retained in a preselected position with a marking character in marking position while other marking wheels are advanced. This operation is illustrated in FIG. 4.

A selected marking wheel 50 may be retained in marking position while the other marking wheels are rotated by maintaining the respective plunger 132 for the associated finger 98 retracted within the block 112. Thus, the valve controlling the flow of air to the particular chamber 118 is not actuated. The spring 110 maintains the finger 98 in abutting relation with the block 112 so that the finger pawl 116 is removed from engagement with the wheel ratchet portion 66. Thus, when the devices 90 and 92 are actuated and the finger 98 is moved in a downward arcuate path the wheel 50 is not rotated because the pawl 116 is not engaged with the wheel ratchet portion 66 as illustrated in FIG. 4. Thus, the finger 98 is swung downwardly but the wheel 50 is not turned.

Once the marking wheels 50 have been moved to selectively position the indicia, the marking or stamping operation is carried out by actuating the striking tool 24. Thus, when selected indicia are in marking position, pivoting of the lever 34 actuates the striking tool 24 to transmit a downward force upon the marking head 36 so that the marking characters strike the object to be marked with a force sufficient to impress in the surface of the object the desired character.

Thus, it will be apparent from the present invention that the marking wheels 50 of the marking head 36 may be selectively turned by selective engagement of the fingers 98 with the ratchet portions 66 of the marking wheels 50. Only those marking wheels 50 engaged by the fingers 98 are rotated. This arrangement facilitates the remote control of turning of the respective marking wheels 50 through the pressure actuated devices 90, 92 and 114. In this manner substantial savings in marking operations are achieved in the form of reduced labor costs in controlling the movement of the marking wheels to place selected indicia in marking position and a reduction in the time of carrying out the marking operation.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Marking apparatus comprising, a marking head, a wheel rotatably supported by said marking head, said wheel having a periphery with a plurality of marking characters positioned thereon, a ratchet portion on said wheel, a first shaft positioned adjacent said wheel, engaging means rotatably positioned on said first shaft for engaging said ratchet portion, said engaging means having a first end portion and a second end portion, said first end portion being movable upon rotation of said engaging means on said first shaft into and out of engagement with said ratchet portion, pressure means for moving said engaging means into engagement with said ratchet portion, said second end portion being positioned in abutting relation with said pressure means, resilient means positioned on said first shaft for exerting a force upon said engaging means to normally maintain said engaging means first end portion disengaged from said ratchet portion and said engaging means second end portion abutting said pressure means, said pressure means being operable upon actuation to apply a force to said engaging means second end portion and overcome the force of said resilient means to pivot said engaging means on said first shaft and move said engaging means first end portion into engagement with said ratchet portion, and actuator means for moving said first shaft in an arcuate path through a preselected angle so that said engaging means moves through a corresponding angle to rotate said wheel in a preselected direction through an angle corresponding to the angle of movement of said engaging means and thereby advance said marking characters on said wheel.

2. Marking apparatus comprising, a marking head, a wheel rotatably supported by said marking head, said wheel having a periphery with a plurality of marking characters positioned thereon, a ratchet portion on said wheel, a first shaft positioned adjacent said wheel, engaging means rotatably positioned on said first shaft for engaging said ratchet portion, said first shaft being normally maintained in a first position adjacent to said ratchet portion when said engaging means is disengaged from said ratchet portion, pressure means for moving said engaging means into engagement with said ratchet portion, said pressure means being operable upon actuation to rotate said engaging means on said first shaft into engagement with said ratchet portion when said first shaft is in said first position, actuator means for moving said first shaft in an arcuate path through a preselected angle so that said engaging means moves through a corresponding angle to rotate said wheel in a preselected direction through an angle corresponding to the angle of movement of said engaging means and thereby advance said marking characters on said wheel, said actuator means being operable upon acutation to move said first shaft in an arcuate path to a second position so that said engaging means being engaged to said ratchet portion rotates said wheel to advance said wheel one marking character, said pressure means being operable upon advancement of said wheel to release said engaging means from engagement with said ratchet portion once said first shaft is moved to said second position, and said actuator means being operable following disengagement of said engaging means from said ratchet portion to move said first shaft from said second position back to said first position.

3. Marking apparatus comprising, a marking head, a wheel rotatably supported by said marking head, said wheel having a periphery with a plurality of marking characters positioned thereon, a ratchet portion on said wheel, a first shaft positioned adjacent said wheel, engaging means rotatably positioned on said first shaft for engaging said ratchet portion, pressure means for moving said engaging means into engagement with said ratchet portion, actuator means for moving said first shaft in an arcuate path through a preselected angle, extensible means associated with said actuator means for limiting rotation of said wheel, said extensible means being connected to said first shaft, and said actuator means being operable upon actuation to extend said extensible means a preselected length and effect limited arcuate movement of said engaging means so that said wheel is turned through a preselected angle to advance the next adjacent marking character into marking position.

4. Marking apparatus as set forth in claim 3 which includes, a second shaft extending through said marking head and rotatably supporting said wheel, lever means for supporting said second shaft at one end portion of said lever means, said pressure means being connected to the opposite end portion of said lever means to support said pressure means in position abutting said engaging means, and said first shaft extending through said lever means so that upon actuation of said actuator means said lever means moves in an arcuate path with said first shaft to thereby move said pressure means and maintain said pressure means in contact with said engaging means.

5. Marking apparatus as set forth in claim 3 which includes, said actuator means being pivotally connected to said marking head, said actuator means being normally maintained in a first position relative to said marking head, said actuator means being operable upon actuation to pivot to a second position on said marking head and with said extensible means extended move said first shaft in said arcuate path through said preselected angle, and said actuator means being operable following rotation of said marking wheel through said preselected angle to retract said extensible means and pivot from said second position back to said first position.

6. Marking apparatus comprising, a marking head, a wheel rotatably supported by said marking head, said wheel having a periphery with a plurality of marking characters positioned thereon, a ratchet portion on said wheel, a first shaft positioned adjacent said wheel, engaging means rotatably positioned on said first shaft for engaging said ratchet portion, pressure means for moving said engaging means into engagement with said ratchet portion, a pair of double-acting, air actuated cylinders, each of said cylinders having an extensible and retractable rod portion, said rod portion being connected to said first shaft, said cylinders being pivotally connected to said marking head, and said cylinders being operable upon actuation to extend said rod portions a preslected length to move said first shaft downwardly in a limited arcuate path through a preselected angle and thereby limit the swing of said engaging means through an angle to rotate said wheel to move one marking character out of marking position and the next adjacent marking character into marking position.

7. Marking apparatus as set forth in claim 6 which includes, said cylinders being further operable to retract said extended rod portions and thereby move said first shaft upwardly in an arcuate path and thereby return said engaging means to its initial position.

8. Marking apparatus comprising, a marking head, a wheel rotatably supported by said marking head, said wheel having a periphery with a plurality of marking characters positioned thereon, a ratchet portion on said wheel, a first shaft positioned adjacent said wheel, engaging means rotatably positioned on said first shaft for engaging said ratchet portion, a block member supported by said marking head adjacent to said engaging means, at least one chamber extending through said block member, said chamber having an inlet and an outlet, a plunger longitudinally positioned in said chamber and having an end portion adapted to move between a first position in said chamber and a second position extended from said chamber outlet into contact with said engaging means, means for selectively supplying air under pressure to said inlet of said chamber and thereby move said plunger from said first position to said second position to exert a force upon said engaging means to pivot said engaging means on said first shaft into engagement with said ratchet portion of said wheel, resilient means for applying a force upon said engaging means to move said plunger from said second position back to said first position when said inlet is vented to permit air to escape from said chamber, and actuator means for moving said first shaft in an arcuate path through a preselected angle so that said engaging means moves through a corresponding angle so that said engaging means moves through a corresponding angle to rotate said wheel in a preselected direction through an angle corresponding to the angle of movement of said engaging means and thereby advance said marking characters on said wheel.

9. Marking apparatus comprising, a marking head, a plurality of wheels rotatably supported by said marking head, said wheels each having a periphery with a plurality of marking characters positioned thereon, a ratchet portion on each of said wheels, a shaft supported adjacent said wheels, engaging means pivotally positioned on said shaft for selectively engaging said ratchet portions of said respective wheels, said engaging means each having a first end portion and a second end portion, said first end portion being movable upon rotation of said engaging means on said first shaft into and out of engagement with said ratchet portion, pressure means for selectively moving preselected ones of said engaging means into engagement with said ratchet portions of said respective wheels, said second end portion being positioned in abutting relation with said pressure means, resilient means positioned on said first shaft for exerting a force upon said engaging means to normally maintain said engaging means first end portions disengaged from said ratchet portion and said engaging means second end portions abutting said pressure means, said pressure means being operable upon actuation to apply a force to said engaging means second end portions and overcome the force of said resilient means to pivot said engaging means on said first shaft and move said engaging means first end portion into engagement with said ratchet portions, and actuator means for moving said shaft in an arcuate path through a preselected angle so that said engaging means move through a corresponding angle to rotate said wheels engaged by said respective engaging means in a preselected direction through an angle corresponding to the angle of movement of said engaging means and thereby selectively advance said marking characters on said wheels.

10. A method for controlling the movement of marking indicia of a marking wheel for a marking apparatus comprising the steps of, rotatably supporting a marking wheel having a ratchet portion in a marking head, rotatably supporting an engaging means adjacent the marking wheel, normally maintaining the engaging means in a first position removed from engagement with the ratchet portion of the marking wheel, pivoting the engaging means in the first position into engagement with the ratchet portion of the marking wheel, moving the engaging means from the first position in an arcuate path through a preselected angle to a second position, turning the marking wheel by movement of the engaging means from the first position to the second position through an angle corresponding to the angle of movement of the engaging means to thereby advance preselected marking indicia on the marking wheel into marking position, releasing the engaging means from engagement with the ratchet portion of the marking wheel after the engaging means is moved to the second position, and thereafter, moving the engaging device disengaged from the marking wheel from the second position back to the first position.

11. A method for controlling the movement of marking indicia of a marking wheel as set forth in claim 10 which includes, rotatably supporting a plurality of marking wheels in the marking head, the marking wheels each having a plurality of marking characters on the periphery thereof and a ratchet portion, rotatably supporting a plurality of engaging means oppositely of the plurality of marking wheels to provide a plurality of pairs of engaging means and marking wheels, pivoting selected ones of said engaging means into engagement with the ratchet portions of the respective marking wheels, moving the engaging means from a first position through an arcuate path of a preselected angle to a second position, rotating the marking wheels engaged to the respective engaging means through a preselected angle corresponding to angle of movement of the engaging means, and advancing selected marking wheels to move the next adjacent marking indicia into marking position upon rotation of the marking wheels through the preselected angle.

12. A method for controlling the movement of marking indicia of a marking wheel as set forth in claim 10 which includes, releasing the engaging means from engagement with the ratchet portion of the marking wheel following turning of the marking wheel through the preselected angle, moving the engaging means in an arcuate path to its initial position, and maintaining the marking wheel fixed as the engaging means is moved to its initial position.

13. A method for controlling the movement of the marking indicia of a marking wheel for marking apparatus comprising the steps of, rotatably supporting a marking wheel having a ratchet portion in a marking head, rotatably supporting an engaging means adjacent the marking wheel, pivotally supporting the engaging means about a fulcrum point of the engaging means on a shaft in a position normally disengaged with the ratchet portion, applying a force to a first end of the engaging means to pivot the engaging means about the fulcrum point on the shaft and move a second end of the engaging means into engagement with the ratchet portion of the marking wheel, maintaining the engaging means in a pivoted position on the shaft and engaged to the ratchet portion of the marking wheel, applying a force to the shaft to move the shaft together with the engaging means in an arcuate path through a preselected angle, turning the marking wheel by movement of the engaging means to advance the next adjacent marking indicia into marking position, thereafter releasing the force applied to the first end of the engaging means, applying a force to the second end of the engaging means to pivot the engaging means about the fulcrum point and move the second end portion of the engaging means out of engagement with the ratchet portion of the marking wheel, applying a force to the shaft to move the shaft together with the engaging means in an arcuate path and return the engaging means to its normally disengaged position with the ratchet portion, and maintaining the marking wheel fixed while returning the engaging means to its normally disengaged position with the ratchet portion.

* * * * *